US007255704B2

(12) United States Patent
Hogan et al.

(10) Patent No.: US 7,255,704 B2
(45) Date of Patent: Aug. 14, 2007

(54) SKIN EXFOLIATING TOOL AND KIT

(75) Inventors: Kristen Shay Hogan, New York, NY (US); Kathleen Marie Hefferle, Shelton, CT (US); Peter John Tuite, Monroe, CT (US); Andre Marie Puleo, Stratford, CT (US); Gina Marie Pisa, Briarcliff Manor, NY (US)

(73) Assignee: Unilever Home & Personal Care USA, Division of Conopco, Inc., Greenwich, CT (US)

( * ) Notice: Subject to any disclaimer, the term of this patent is extended or adjusted under 35 U.S.C. 154(b) by 253 days.

(21) Appl. No.: 10/998,926

(22) Filed: Nov. 29, 2004

(65) Prior Publication Data

US 2006/0116694 A1 Jun. 1, 2006

(51) Int. Cl.
*A61B 17/50* (2006.01)

(52) U.S. Cl. ..... 606/131

(58) Field of Classification Search ..... 606/131, 606/132, 84, 85; 451/488; 132/75.6, 76.4, 132/76.5; 428/143, 145; D28/59, 63; 206/361
See application file for complete search history.

(56) References Cited

U.S. PATENT DOCUMENTS 4,998,545 A * 3/1991 Hiromura ..... 132/290
5,240,339 A * 8/1993 DeForest et al. ..... 401/207
5,360,111 A * 11/1994 Arispe ..... 206/361

* cited by examiner

*Primary Examiner*—Michael J. Hayes
*Assistant Examiner*—Christina Gettman
(74) *Attorney, Agent, or Firm*—Milton L. Honig

(57) ABSTRACT

A skin exfoliating tool and kit is provided wherein the tool includes an applicator wand and a drying tray. The wand features a gripping handle, a platform projecting circumferentially outward from the handle and a pliable pad attached to the platform. The wand nests in the drying tray, the latter being formed with a cavity for receiving the pad, the cavity being defined by a floor and an open mouth. The tray has at least one drainage orifice adjacent the floor. The kit incorporates the exfoliating tool in combination with a skin exfoliating composition that is formulated with abrasive particles in a carrier vehicle.

8 Claims, 1 Drawing Sheet

SKIN EXFOLIATING TOOL AND KIT

BACKGROUND OF THE INVENTION

1. Field of the Invention

The invention concerns a tool and kit for exfoliating skin, particularly for microabrasion of the dermis.

2. The Related Art

Exfoliation of skin can be accomplished through abrasive cosmetic compositions, mechanical implements and combinations of these procedures. The process can impart a fresh and healthy appearance in addition to removing dull layers of dead skin.

Recently products have entered the market particularly focusing upon microdermabrasion. La Prairie sells a microdermabrasion system featuring a cream formulated with "natural diamonds", "freshwater pearls" and "crystal quartz". The cream is sold with three specially designed applicators, one for use on the face and two for the body. These applicators employ plastic handles and a massage pad attached thereto. Other products such as the Vita-K Microdermabrasion kit packages a resurfacing cream, a bottle of smoothing serum and a battery operated mechanical massage brush with two attachments.

Although many of the products being marketed are effective exfoliating systems, those which use implements can be subject to microbiological contamination. There are many sources of contamination, particularly in situations where a wetted pad is improperly dried. Moist enclosed environments tend to allow for the growth of microorganisms.

An object of the present invention is to provide a tool and kit that avoids the problem of microbiological contamination.

SUMMARY OF THE INVENTION

The object of the present invention is achieved through a skin exfoliating tool which includes an applicator wand. The wand is formed with a gripping handle, a platform with upper and lower surfaces and which projects outward from the handle, and a pliable pad. The pad is attached to the platform adjacent the lower surface thereof while the handle is adjacent the upper surface thereof A drying tray is formed with a cavity for receiving the pad. The cavity is defined by a floor and juxtaposed by an open mouth. The tray has at least one drainage orifice adjacent the floor.

The present invention further includes a kit for exfoliating skin. The kit includes a skin exfoliating composition having an effective amount of abrasive particles in a carrier vehicle. The second item of the kit is a skin exfoliating tool. This tool includes an applicator wand with a gripping handle, a platform with upper and lower surfaces and which projects outward from the handle, and a pliable pad. The pad is attached to the platform adjacent the lower surface thereof while the handle is attached adjacent the upper surface thereof. A drying tray is formed with a cavity for receiving the pad. The cavity is defined by a floor and juxtaposed by an open mouth. The tray has at least one drainage orifice adjacent the floor.

BRIEF DESCRIPTION OF THE DRAWING

Various features and advantages of the present invention will be described in conjunction with the following drawings in which.

DETAILED DESCRIPTION OF THE INVENTION

Now there is described a skin exfoliating tool and kit which avoids growth of microorganisms between treatments. Particular anti-microcontamination features includes a rinse water drainage mechanism and an air flow mechanism to insure rapid dying of the tool subsequent to use.

Figure 1:
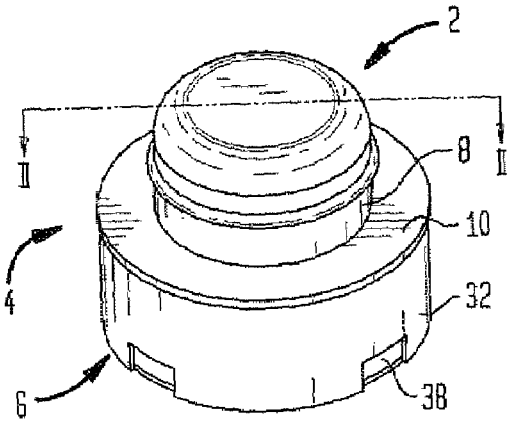
FIG. 1 is a plan perspective view of the skin exfoliating tool according to the present invention.

FIG. 1 illustrates the tool 2 which features an applicator wand 4 and a drying tray 6. The wand includes a unitarily molded gripping handle 8 with a platform 10 projecting outward and circumferentially surrounding the handle.

Figure 2:
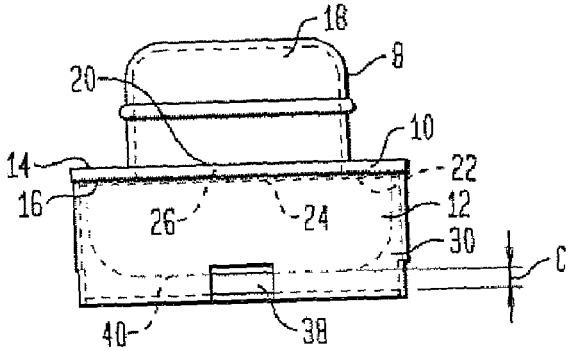
FIG. 2 is a cross-sectional view of the skin exfoliating tool taken along line II-II of FIG. 1.
Figure 3:
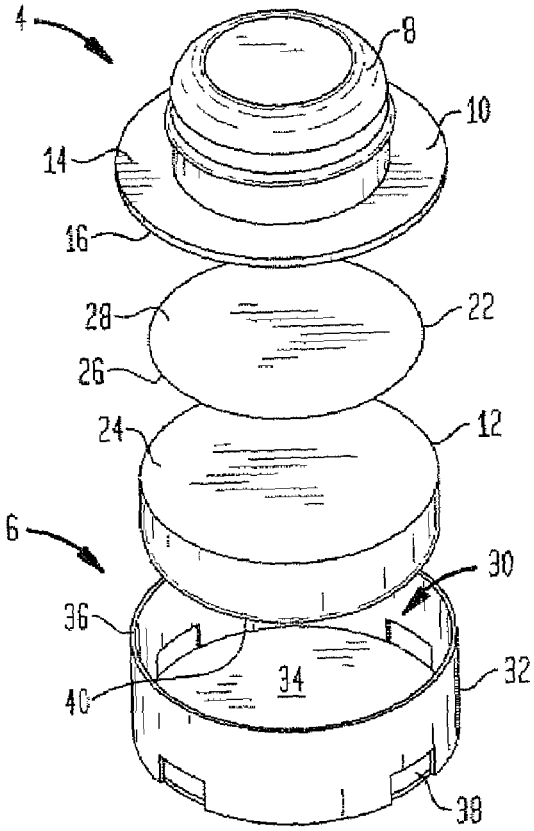
FIG. 3 is an exploded view of the tool illustrated in FIG. 1.

FIGS. 2 and 3 illustrate the presence of a pliable pad 12 as a component of the wand. Platform 10 is characterized by an upper surface 14 and a lower surface 16. Pad 12 is arranged adjacent the lower surface 16 and the handle positioned adjacent the upper surface 14.

Handle 8 features a hollow area 18 which can be accessed through a single large aperture 20. Hollow area 18 presents a space which has potential for growth of microorganisms. According to the present invention, the hollow area is sealed against entry of contaminated rinse water and other contaminant bearing liquids by closure with a sealing disc 22. The platform lower surface 16 provides a support against which the sealing disc 22 can be adhesively attached. Pad 12 along a flattened surface 24 is adhesively bound to disc face 26 of the sealing disc 22, and thereby to the handle and wand. Disc 22 is bound to the platform through a disc face 28 opposite disc face 26.

The applicator wand 4 is readily separable and rests on drying tray 6. The tray is formed with a receiving cavity 30 for accepting the pad. The cavity 30 is circumscribed by a cylindrical tray wall 32 and defined by a floor 34 juxtaposed by an open mouth 36.

A series of drainage apertures 38 are arranged along a lower edge of the circumferential tray wall 32 and adjacent to floor 34. Although the number of drainage orifices need not be limited, for practical purposes they may range in number from 1 to about 20, preferably from 3 to 12.

Materials of construction for the gripping handle/platform may be any plastic, particularly polyolefins and most especially polypropylene. The applicator wand with the exception of the pad and sealing disc may be formed from a single unitary molded plastic. The pliable pad may be formed of any flexible material including natural sponge, cellulosic (e.g. cotton pad) or synthetic elastomer. Among elastomers most preferred are those of polyurethane and polyethylene. The disc is preferably formed of polyethylene. Thickness of the disc may range in a preferred embodiment from 0.01 to 2 mm, more preferably from 0.05 to 0.5 mm. The disc and platform may have a relative thickness ratio of from 1:3 to 1:100, preferably 1:5 to 1:20. A particularly suitable adhesive is tackified acrylate polymer, applied to both major faces of the disc.

For microbial integrity, it is important that the exterior abrading surface 40 of the pad not contact the tray floor 34. Avoidance of contact is ensured by limiting the length of the applicator wand portion that projects into the receiving cavity 30 by an amount less than the depth of that cavity. This is best illustrated in FIG. 2 where the clearance depth amount is indicated by the letter C. The clearance amount or gap will depend upon the size of the tool. In the present embodiment the gap can range from about 1 to about 20, preferably from about 2 to about 4 mm.

Tools of the present invention often will be packaged in a kit alongside a skin exfoliating composition. The composition can be contained in a jar with a mouth of sufficient width to allow access for dipping of the applicator wand into the composition.

Components of the skin exfoliating composition ordinarily will include an effective amount of abrasive particles, particularly amounts ranging from about 0.5 to about 50%, preferably from about 3 to about 30%, and optimally from about 10 to about 25% by weight of the composition. Inorganic or organic materials can be used as the abrasive particles. Illustrative inorganic materials are pumice, calcite, zeolite, alumina and silicates. Organic substances may include wax (e.g. jojoba or petroleum derived wax) and water-insoluble plastics. The latter include particles of polyethylene, polypropylene, polyurethane, polyamide, polyester and polystyrene. Particularly preferred is polyethylene.

Carrier vehicles in the amount of from about 1 to about 99% by weight of the composition may constitute a significant part of the compositions. Carrier vehicles may include water, emollients, emulsifiers, thickeners and generally combinations thereof. Emollients may include hydrocarbons, esters, silicones and vegetable oils (e.g. triglycerides). Emulsifiers may be selected from nonionic, anionic, cationic, amphoteric and mixtures of such emulsifiers. Thickeners may be organic or inorganic and can include clays, cellulosics, chemically modified cellulosics, high molecular weight hydrocarbons and silicones, carboxyvinyl crosslinked copolymers and combinations thereof.

The method of using the kit is performed in the following manner. A consumer grips the applicator wand and dips the pad into the skin exfoliating composition. Thereupon the wand with a small amount of composition on the pad is applied to the face and/or other parts of the user's body. The wand with the composition is then through rapid circular motion pressed against the skin allowing the abrasive particles to exfoliate the dermis. Thereafter the user rinses the treated area with water to remove the composition and any debris. The dipping and application procedure can be repeated as often as desired by the consumer. When treatment is complete, the consumer can rinse with fresh water the applicator wand, particularly the pad area. The wand is then returned to the drying tray with pad facing downward. Water is allowed to drain from the pad into the tray and outward through the drainage orifices. Natural air currents which have access through the orifices and across the gap between the pad abrading surface and tray floor allow for removal of any residual moisture. The resultant fast dry procedure eliminates the danger of microorganism accumulation on surfaces of the pad.

What is claimed is:

1. A skin exfoliating tool comprising:

(i) a applicator wand comprising:

a gripping handle comprising a hollow area therewithin;

a platform with upper and lower surfaces, the platform projecting outward from the handle, the platform and handle being unitarily molded;

a pliable pad attached to the platform, the pad being adjacent the lower surface and the handle being adjacent the upper surface;

a sealing disc separating the gripping handle from the pad to prevent fluid transport to the handle from the pad, the hollow area of the handle being sealed against ingress of the fluid by the sealing disc covering a mouth of the hollow area; and (ii) a drying tray formed with a cavity for receiving the pad, the cavity defined by a floor and juxtaposed by an open mouth, the tray having at least one drainage orifice adjacent the floor, the tray being separable from the applicator wand.

2. The tool according to claim 1 wherein the wand when positioned to nest within the drying tray allows a clearance between the tray floor and a downwardmost projecting abrading surface of the pad.

3. The tool according to claim 1 wherein the at least one drainage orifice numbers from 3 to about 20 orifices.

4. A kit for exfoliating skin comprising:

(A) a skin exfoliating composition comprising an effective amount of abrasive particles in a carrier vehicle; and (B) a skin exfoliating tool comprising:

(i) a applicator wand comprising:

a gripping handle comprising a hollow area therewithin;

a platform with upper and lower surfaces, the platform projecting outward from the handle, the platform and handle being unitarily molded;

a pliable pad attached to the platform, the pad being adjacent the lower surface and the handle being adjacent the upper surface;

a sealing disc separating the gripping handle from the pad to prevent fluid transport to the handle from the gad, the hollow area of the handle being sealed against ingress of the fluid by the sealing disc covering a mouth of the hollow area; and (ii) a drying tray formed with a cavity for receiving the pad, the cavity defined by a floor and juxtaposed by an open mouth, the tray having at least one drainage orifice adjacent the floor, the tray being readily separable from the applicator wand.

5. The kit according to claim 4 wherein the wand when positioned to nest within the drying tray allows a clearance between the tray floor and a downwardmost projecting abrading surface of the pad.

6. The kit according to claim 4 wherein the at least one drainage orifice numbers from 3 to about 20 orifices.

7. The kit according to claim 4 wherein the floor has no drainage orifices.

8. The tool according to claim 1 wherein the floor has no drainage orifices.

* * * * *